United States Patent [19]

Wing

[11] Patent Number: 4,917,323

[45] Date of Patent: Apr. 17, 1990

[54] CHRISTMAS LIGHT STORAGE DEVICE

[76] Inventor: Don Wing, 11765 General Giraud, Montreal, Quebec, Canada, H4S 2H7

[21] Appl. No.: 269,614

[22] Filed: Nov. 10, 1988

[51] Int. Cl.[4] ..... B65H 75/40; B65D 85/42

[52] U.S. Cl. ..... 242/96; 242/85.1; D8/358; 206/419; 362/806

[58] Field of Search ..... 242/96, 85.1, 118.4; 43/57.3; 206/389, 419; D8/358, 59; 362/123, 227, 238, 249, 806

[56] References Cited

U.S. PATENT DOCUMENTS

| | | | |
|---|---|---|---|
| D. 180,633 | 7/1957 | Wilke | D8/358 |
| 2,984,347 | 5/1961 | Kalinchuk | 206/419 |
| 3,085,767 | 4/1963 | Zerbest | 242/106 |
| 3,931,887 | 1/1976 | Beck | 206/419 |
| 4,542,862 | 9/1985 | Romike et al. | 242/118.4 X |
| 4,720,773 | 1/1988 | Ahroni | 362/123 X |
| 4,763,855 | 8/1988 | Divincenzo | 242/85.1 X |

*Primary Examiner*—Stuart S. Levy
*Assistant Examiner*—Steven M. duBois
*Attorney, Agent, or Firm*—Shlesinger & Myers

[57] ABSTRACT

A Christmas tree light storage device consisting of one or more discs each with a plurality of radially oriented slots around the outside circumference thereof which disc or discs are concentrically mounted on a central cylinder wherein light sockets are mounted sequentially over the slots with the cable to and from the sockets passing through the slots and being wrapped around the central cylinder.

13 Claims, 3 Drawing Sheets

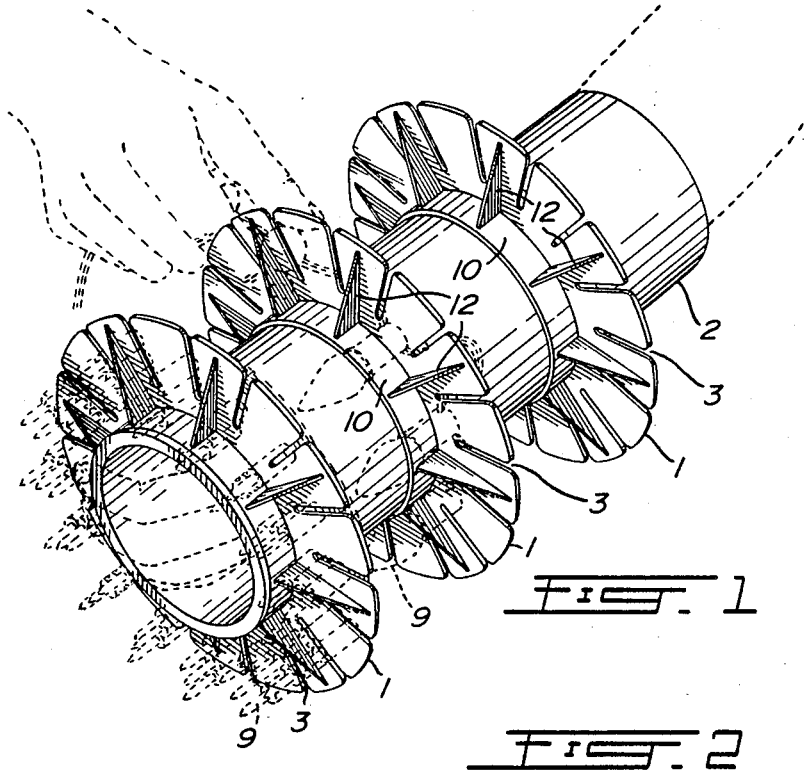
FIG. 1
FIG. 2
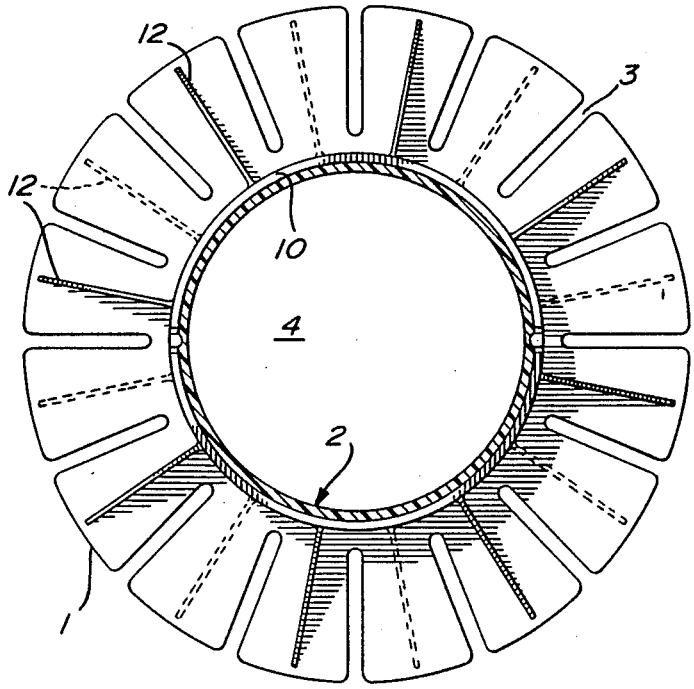

FIG. 4
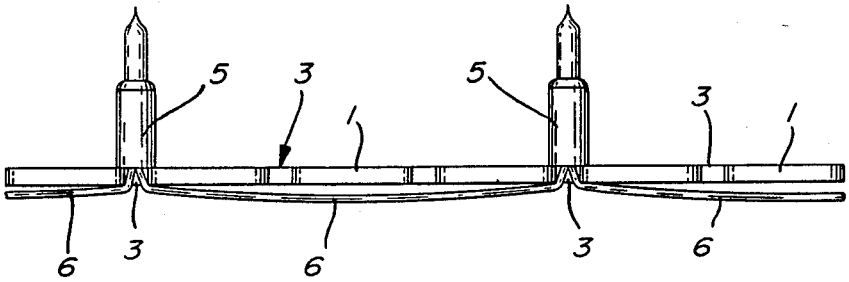
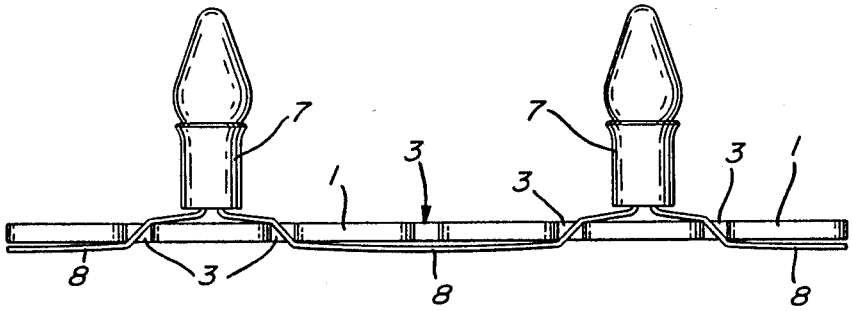
FIG. 5

CHRISTMAS LIGHT STORAGE DEVICE

FIELD OF THE INVENTION

This invention relates to a device for storing lights such as Christmas tree lights strung on an electric cord.

BACKGROUND OF THE INVENTION

Traditionally sets of Christmas tree lights have been used to decorate indoor and outdoor Christmas trees, window frames, door frames and numerous other areas during festive seasons. These lights which vary in size come in strings of a dozen or more lights on one cable. Typically 2 or more dozen lights or sets of lights are used to decorate a tree.

When first purchased strings of lights generally come in boxes which are not particularly suitable for storing the sets of lights in an orderly fashion thereafter. Because the sets are rather cumbersome to handle often being eight feet or more in length they are simply stuffed in boxes or bags for storage. Unfortunately, when the next season arrives these sets of lights are all tangled and in the process of untangling them generally several bulbs are broken. Even after the sets have been untangled it is still cumbersome to mount these on a tree, for example, because as the user mounts the first couple of lights he/she is hampered by a long strong of lights which is difficult to maneuver around the tree for the reason that it gets stuck in the branches or around the ladders if one is being used. In the process of untangling the lights still more lamps are broken.

It is an object of this invention to provide a storage device designed to keep Christmas tree lights stored in an orderly way such that they do not become tangled.

It is a further object of this invention to provide a device which will facilitate the mounting of Christmas tree lights and their removal at the end of the season.

DESCRIPTION OF THE INVENTION

The invention comprises a disc with a plurality of radially oriented slots around the outside circumference. The diameter of the disc and the depth of the slots may be determined by the size and number of the light sockets on the sets to be stored on the disc. The disc may be made of plastic on any other suitable material. The disc is disposed concentrically on a cylinder. The latter having a diameter such that it may pass over the user's arm thereby permitting easy manipulation of the disc both as the sets are stored onto and removed from the storage disc. Of course, in order to accommodate several sets of lamps several of the discs of this invention may be disposed concentrically on the central cylinder.

The lights sockets are stored sequentially over the slots with the cable to and from the sockets passing through the slots. After placing the first light socket on the storage device the cylinder is rotated thus coiling the cable between adjacent light sockets around the cylinder with the next adjacent light socket being placed over the next most convenient slot. The process is then repeated sequentially until all of the light sockets on the string have been mounted on the storage device. In this way, the light sockets are all held in place by the cable which has been wrapped around the cylinder. When removing the light sockets from the storage device the process is simply reversed.

IN THE DRAWINGS

FIG. 1 is a perspective view of the Christmas tree light storage device of the invention consisting of 3 discs disposed on a central cylinder.

FIG. 2 is a plan view of the disc of the Christmas tree light storage device.

FIGS. 4 and 5 show different methods of mounting Christmas tree lights on the Christmas tree light storage device.

DETAILED DESCRIPTION OF A SPECIFIC EMBODIMENT OF THE INVENTION

Figure 3:
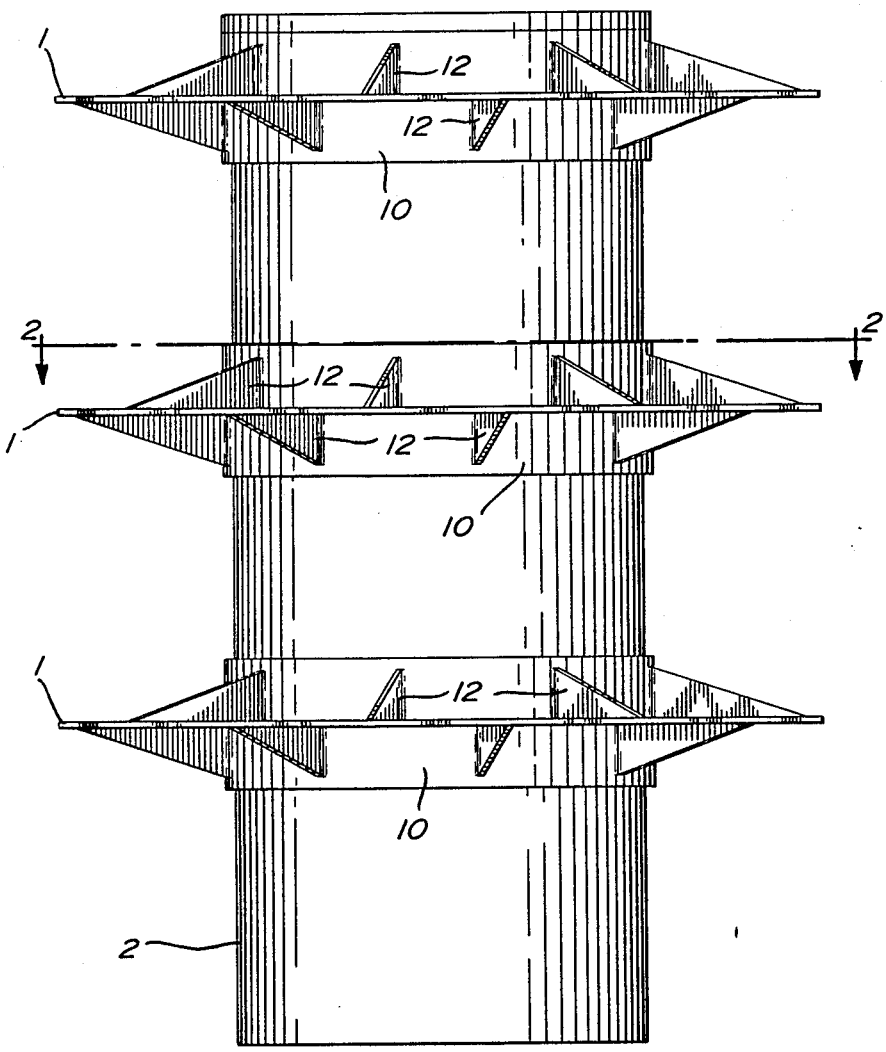
FIG. 3 is an elevational view of the Christmas tree light storage device consisting of 3 discs disposed over a central cylinder.

Referring to FIG. 1, three storage discs 1 of the invention are shown mounted on cylinder 2. Disc 1 includes a plurality of radially disposed slots 3 on the circumference thereof. The depth of slots 3 may be varied depending on the type of Christmas lights being stored but is typically in the 1" to 3" range. Each disc 1 has an integral collar 10 extending longitudinally along the cylinder 2. A plurality of supports 12 extend from the collar 10 and along an associated portion of the disc 1 between an adjacent pair of slots 3. Each support 12 is triangular in plan and the portion extending along the collar 10 is of a length substantially equal to the length of the collar 10, while the portion extending between the slots 3 is of a length substantially equal to the distance between collar 10 and the periphery of the disc 1. As best shown in FIGS. 2 and 3, slots 3 and supports 12 of each disc 1 are in longitudinal alignment with the slots 3 and supports 12 of the adjacent discs 1.

Of course the length of cylinder 2 depends on the number of discs 1 to be included in the same storage device. In any case the length of cylinder 2 when used with 1 disc 1 and the spacing on cylinder 2 between each disc 1 when several discs 1 are used must be sufficient to accommodate the electrical cable to be wrapped around the cylinder.

Disc 1 includes a central cut out 4 permitting disc 1 to be slid onto cylinder 2. Alternatively disc 1 and cylinder 2 may be molded or constructed in one piece.

In operation, disc 1 and cylinder 2 are manipulated by hand by the user while the user either mounts or removes Christmas lights 9 from disc 1. In order to accommodate several sets of lights and to provide for greater storage efficiency several discs may be concentrically mounted on cylinder 2 as shown in FIG. 1. In this case, cylinder 2 may be passed over the user's arm for easy manipulation of the storage discs with one hand while mounting or removing Christmas lights from the storage discs with the other hand.

In operation when mounting Christmas lights on a tree or elsewhere, the user removes the lights sequentially while rotating disc 1 as the case may be. When the time comes to store the lights the process is reversed. The first light socket or perhaps the electrical connection socket is mounted on a slot with the cable then being wound around the cylinder with adjacent light sockets being mounted over slots separated circumferencially by approximately the length of the cable between these adjacent light sockets.

In FIG. 4 is illustrated a mounting method for typical sets of miniature lights. FIG. 5 shows an alternative mounting method for sets with larger light sockets. In FIG. 4 miniature light sockets 5 are mounted above slots 3 of disc 1 with cable 6 between adjacent miniature sockets 5 stretched between slots 3 separated sufficiently such that cable 6 remains reasonably tightly wrapped around cylinder 2 (not shown) in order to hold miniature light sockets 5 in place. In FIG. 5 light sockets 7 are mounted above disc 1 with cables 8 to and from each light socket passing through adjacent slots 3 with cable 8 between adjacent light sockets 7 being wrapped around cylinder 2 (not shown) with the next adjacent light socket 7 being placed over the convenient slot 3 in order to keep cable 8 reasonably tightly wrapped around cylinder 2 (not shown).

While a particular embodiment of the present invention has been shown and described, it is apparent that various changes and modifications may be made. The invention is of course not limited to the storage of Christmas tree lights but is applicable to the storage of sets of similar type lights used for other purposes. It is therefore intended in the following claims to cover all such obvious modifications and changes as may fall within the true spirit and scope of this invention.

The embodiments of the invention in which an exclusive property or privilege is claimed and defined as follows:

1. A storage assembly for electric light sockets carried by a cable, the assembly comprising:
(a) cylinder means; and,
(b) at least first and second discs mounted about said cylinder means in longitudinally spaced relation and extending generally transverse to the axis of rotation of said cylinder means, each of said discs having a plurality of radially extending slots opening on the periphery thereof for receiving therein a length of cable, wherein each disc includes: an integral collar mounted to and extending longitudinally along said cylinder means; and, a plurality of integral supports, each support extending between said collar and that portion of the disc extending between an associated two of said slots.

2. The assembly of claim 1, wherein:
(a) the slots of said discs are longitudinally aligned.

3. The assembly of claim 1, wherein:
(a) the supports of said discs being longitudinally aligned.

4. The assembly of claim 1, wherein:
(a) the number of supports is less than the number of slots.

5. The assembly of claim 1, wherein:
(a) each support is triangular in plan and has a first portion extending from and of a length substantially equal to the distance between the associated disc and an end of the associated collar, and a second portion extending from and of a length substantially equal to the distance between the associated collar and the periphery of the associated disc.

6. The assembly of claim 1, wherein:
(a) each slot having a length substantially equal to the distance between said cylinder means and the periphery of the associated disc.

7. The assembly of claim 6, wherein:
(a) each slot having a length of between about 1 to about 3 inches.

8. The assembly of claim 1, wherein:
(a) there being two slots disposed between each pair of adjacently disposed supports.

9. The assembly of claim 1, wherein:
(a) each disc being comprised of plastic.

10. The assembly of claim 1, wherein:
(a) said collars extending in the same direction along said cylinder means.

11. The method of storing lights on an assembly comprising cylinder means having at least a first disc with a plurality of radially extending slots opening on the circumference thereof, the method comprising the steps of:
(a) sliding a light socket along one of the slots so that the socket extends from a first surface of the disc and the electric cable to which the socket is attached extends from an opposite second surface of the disc;
(b) rotating the cylinder means on the axis thereof and thereby advancing the disc to another slot; and,
(c) sliding a second socket along the another slot so that the second socket extends from the first surface of the disc and the electric cable to which the second socket is attached extends from the second surface of the disc.

12. The method of claim 11, further including the step of:
(a) advancing the disc to the next subsequent slot.

13. The method of storing lights on an assembly comprising cylinder means having at least a first disc with a plurality of radially extending slots opening on the circumference of the disc, the method comprising the steps of:
(a) positioning a first socket on a first surface of the disc between an adjacent two of the slots;
(b) sliding the cables extending from the first socket along the slots so that one cable is positioned in a first slot and another cable is positioned in a second slot and further so that the remaining portion of the cables extends along an opposite second surface of the disc;
(c) rotating the cylinder means on the axis thereof and thereby advancing the disc to two other slots;
(d) positioning a second socket on the first surface between the two other slots;
(e) sliding the cables extending from the second socket along the two other slots so that one cable is positioned in a first one of the two other slots and another cable is positioned in a second one of the two other slots and further so that the remaining portions of the cables extend along the second surface.

* * * * *